US005159717A

United States Patent [19]

Drew et al.

[11] Patent Number: 5,159,717

[45] Date of Patent: Nov. 3, 1992

[54] HAND PADDING DEVICE

[75] Inventors: Terrence M. Drew; Chris A. Hanson; Alden B. Hanson, all of Boulder, Colo.

[73] Assignee: Alden Laboratories, Inc., Boulder, Colo.

[21] Appl. No.: 537,055

[22] Filed: Jun. 13, 1990

Related U.S. Application Data

[63] Continuation-in-part of Ser. No. 757,955, Oct. 14, 1988, Pat. No. 4,952,439.

[51] Int. Cl.[5] ..... A41D 19/00

[52] U.S. Cl. ..... 2/20; 2/161 A; 2/19

[58] Field of Search ..... 2/16, 18, 19, 20, 161 A, 2/164, 167, 160; 5/450

[56] References Cited

U.S. PATENT DOCUMENTS

| | | | |
|---|---|---|---|
| 450,717 | 4/1891 | Reach | 2/19 |
| 1,797,116 | 3/1931 | Barden | 2/19 |
| 1,974,616 | 9/1934 | Kirkham | 2/19 |
| 2,695,999 | 12/1954 | Arnold | 2/20 |
| 3,237,319 | 3/1966 | Hanson | 36/2.5 |
| 3,402,411 | 9/1968 | Hanson | 12/142 |
| 3,635,849 | 1/1972 | Hanson | 260/2.5 B |
| 3,890,648 | 6/1975 | Beal | 2/20 |
| 4,038,762 | 8/1977 | Swan, Jr. | 36/89 |
| 4,051,553 | 10/1977 | Howard | 2/161 A |
| 4,083,127 | 4/1978 | Hanson | 36/93 |
| 4,089,070 | 5/1978 | Cherry | 2/161 A |
| 4,108,928 | 8/1978 | Swan, Jr. | 264/26 |
| 4,144,658 | 3/1979 | Swan, Jr. | 36/117 |
| 4,229,546 | 10/1980 | Swan, Jr. | 36/71 X |
| 4,243,754 | 1/1981 | Swan, Jr. | 521/55 |
| 4,471,538 | 9/1984 | Pomeranz et al. | 2/159 X |
| 4,546,495 | 10/1985 | Castillo | 2/161 A |
| 4,617,684 | 10/1986 | Green et al. | 2/20 |
| 4,624,016 | 11/1986 | Luevano | 2/20 X |
| 4,630,318 | 12/1986 | Aoki | 2/19 |
| 4,748,690 | 6/1988 | Webster | 2/19 |
| 4,802,669 | 2/1989 | Birmingham | 273/26 C |
| 4,945,571 | 8/1990 | Calvert | 2/161 A X |
| 4,952,439 | 8/1990 | Hanson | 5/450 X |

*Primary Examiner*—Werner H. Schroeder
*Assistant Examiner*—Sara M. Current
*Attorney, Agent, or Firm*—Sheridan Ross & McIntosh

[57] ABSTRACT

A hand padding device comprising a pliable enclosure containing a flowable material. The device is designed to be inserted into a ball glove. Preferably, the padding device includes two convex surfaces.

21 Claims, 4 Drawing Sheets

HAND PADDING DEVICE

This is a continuation-in-part of application Ser. No. 07/257,955, filed Oct. 14, 1988, now U.S. Pat. No. 4,952,439 which is hereby incorporated by reference in its entirety herein.

FIELD OF THE INVENTION

This invention relates generally to the field of padding devices, and more particularly to hand padding devices which are used to partially absorb and distribute forces exerted on the hand when catching or contacting a ball.

BACKGROUND OF THE INVENTION

Since the inception of games in which a ball is either caught or contacted by a hand, players of such games have used various innovative means to protect their hands from related pain, discomfort, and injury. For instance, baseball players have employed simple thin gloves (i.e., batting gloves) on the inside of baseball gloves to reduce the pain and discomfort often experienced when catching a ball. However, batting gloves possess minimal impact absorbing characteristics and, quite possibly, possess even less ability to distribute the forces generated at impact evenly over a larger area of the hand. Consequently, some players have placed foam pads inside the batting gloves to further enhance protection of the hand. However, these attempts have met with only limited success due to the deficiencies inherent with foam pads.

There are a wide variety of foams which possess different properties and characteristics which can be used as a hand padding device. However, a majority of foams have certain deficiencies which results in such foams not being an optimal material for such padding devices. For instance, "soft" foams offer little protection to the hand since they are easily compressed and tend to "bottom out" (fully compress), and thus they absorb little of the ball's impact force. "Harder" foams, on the other hand, may improve protection of the hand by providing a higher resistance to compression, but they also cause the user to lose a feel for the ball and such foams may cause the ball to simply pop out of the glove due to their rigidity. Regardless of the type of foam used, such pads may also affect the maneuverability of the baseball glove because of their added bulk. Moreover, such pads generally tend to become displaced inside the baseball glove and thus often do not adequately cover the sensitive areas of the hand to be protected. Because of these deficiencies, there have been attempts to produce a padding device which sufficiently protects the hand without affecting the control and maneuverability of the baseball glove.

U.S. Pat. No. 4,617,684 by Green, issued Oct. 21, 1986, discloses a substantially planar and flexible protective palm pad of multi-layer construction. The ability of the user to control the baseball glove is allegedly not affected by the palm pad which is secured to the user's hand by loops to prevent the palm pad from becoming displaced. The palm pad, which is used inside the baseball glove, has a flexible facing layer of leather and a backing layer of a "shock absorbent material" which allegedly does not cause or permit the ball to rebound from the glove, unlike a compressible foam or sponge. However, there is no disclosure regarding the types of materials which exhibit these specific shock absorbing characteristics. Moreover, there is no suggestion that the pad functions to evenly distribute impact forces throughout the pad.

U.S. Pat. No. 3,890,648 by Beal, issued Jun. 24, 1975, discloses a protective device of single layer construction for use by a player of a hardball game such as baseball, the single layer being a material which exhibits impact absorbing characteristics such as leather or plastic. The protective device consists of two portions, one portion which covers the palm area as well as the bones at the base of the fingers, and one portion which extends up the index finger. A mechanism is also included with the device for attachment to the hand, namely a loop on a portion of the pad which accommodates insertion of the index finger, to prevent the protective device from becoming displaced. However, there is no suggestion that the protective device functions to evenly distribute impact forces throughout the device, and in fact its impact absorbing abilities may be somewhat limited since leather or plastics are being used.

U.S. Pat. No. 4,748,690 by Webster, issued Jun. 7, 1988, discloses a protective glove having a plurality of non-springy, shock absorbing cushions positioned throughout, namely in the finger and base of the finger regions of the hand. The protective glove is worn on the inside of a baseball glove to protect these areas of the hand when catching a hard ball. However, there is no disclosure regarding the types of specific materials which provide the stated impact absorbing characteristics, nor is there any suggestion that the cushions function to evenly distribute the forces exerted on the hand.

Although devices such as those mentioned above may provide some degree of protection to the hand above and beyond batting gloves, such devices still suffer from a number of deficiencies. As a result, there is a need for a padding device which not only absorbs the forces of impact, but which also distributes such forces over a larger area. There is also a need for a padding device which does not become easily displaced when used and which does not adversely affect a user's control of a baseball glove.

SUMMARY OF THE INVENTION

In accordance with the present invention, a hand padding device is provided which utilizes flowable materials and has excellent impact absorbtion and distribution characteristics. The hand padding device of the present invention is designed for use in combination with a baseball or other glove in which the user experiences a concentrated force when catching or contacting a ball. The hand padding device can either be placed in the palm of the user's hand or inserted into a pocket or sleeve of the glove which is specifically designed for receiving the hand padding device.

The hand padding device of the present invention employs a flowable material in a preformed enclosure to partially absorb and distribute forces generated by impact with a ball. The advantages inherent in the hand padding device of the present invention are largely attributable to the use of flowable materials and the preformed shape of the enclosure containing the flowable materials. The combination produces a flexible padding device which substantially conforms to the contour of both the user's hand and the ball to thereby more evenly distribute the impact force over a larger area. Moreover, some of the energy transferred to the padding device is dissipated in deforming the enclosure and in transferring flowable materials throughout the enclosure.

When a user of the hand padding device of the present invention catches or contacts a ball, a force is indirectly exerted on the outer surface of the hand padding device which causes the flowable materials in the region of the applied force to migrate to other regions of the hand padding device. Consequently, some of the energy transferred at impact is dissipated by that energy used to transfer these flowable materials. Moreover, the applied force causes the outer surface of the enclosure containing the flowable materials to stretch which also dissipates a portion of the energy. A further result of the deformation of the hand padding device due to impact is that the enclosure substantially conforms to both the hand and the ball, thereby effectively distributing the impact forces over a larger area of the hand.

The preferred embodiment of the present invention is a pliable, three dimensional enclosure having two surfaces which have curvatures in at least one reference plane, both of such surfaces being convexly shaped. Preferably, both surfaces will have curvatures in two reference planes. The inner convex surface of the padding device contacts or faces the user's hand while the outer convex surface faces the palm of the baseball glove and thus indirectly contacts the ball.

A second embodiment of the present invention is a pliable, three-dimensional enclosure having an outer surface which is substantially planar and an inner surface with a curvature in at least one reference plane, the inner curved surface being convexly shaped. Preferably, the inner, convex surface will have curvatures in two reference planes. The inner convex surface of the padding device either contacts or faces the user's hand, while the substantially planar outer surface faces the palm of the baseball glove and thus indirectly contacts the ball.

A third embodiment of the present invention is a pliable enclosure having two substantially planar surfaces. Although the enclosure is a single chamber, the geometric configuration of the third embodiment is such that there is a substantially circular inner central region surrounded by a plurality of extensions, the outer edges of which substantially form the contour of a circle, which are connected to the inner central region. The extensions serve to reduce the number of creases which tend to develop within the hand padding device when the hand padding device is placed on a curved surface, such as the inner surface of a baseball glove and/or a user's hand, and when the hand padding device experiences an applied force causing deformation of the enclosure.

The fourth embodiment of the present invention is a pliable enclosure having two substantially planar surfaces.

Each of the above-described embodiments can include as part of the enclosure a portion which extends up the index finger of the user. This finger covering portion increases the area covered by the padding device and thus protects another sensitive portion of the hand.

DETAILED DESCRIPTION OF THE INVENTION

Figure 1:
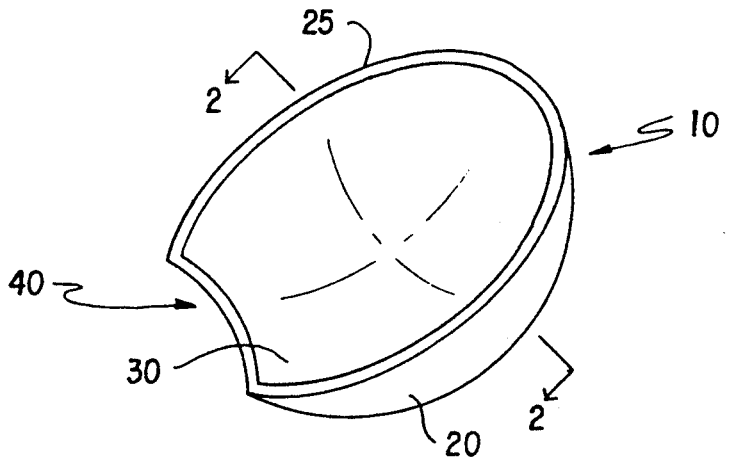
FIG. 1 is a perspective view of the preferred embodiment of the present invention illustrating two convex surfaces.
Figure 2:
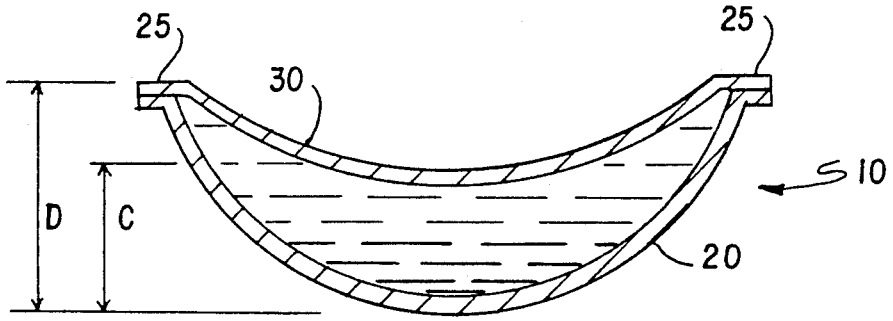
FIG. 2 is a cross-sectional view of the hand padding device of FIG. 1 along centerline 2—2 of FIG. 1.
Figure 3:
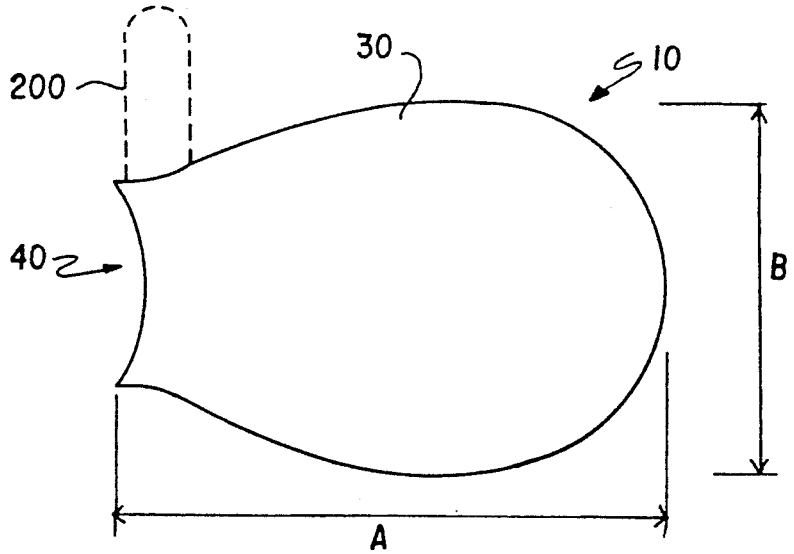
FIG. 3 is a top view of the hand padding device of FIG. 1, the dashed line illustrating an embodiment of the present invention which incorporates an extension of the enclosure for protecting the index finger.

The present invention will be discussed with reference to the attached figures. FIGS. 1, 2, and 3 illustrate the preferred embodiment of the present invention. Hand padding device 10 is formed by joining pliable material 20 to pliable material 30 to form a generally cup-shaped enclosure which contains flowable material, the perimeter of which approximates the shape of a horseshoe. Pliable materials 20 and 30 have either spherical surfaces (curved in more than one reference plane) or surfaces which are curved in at least one reference plane, the surfaces of pliable materials 20 and 30 being convexly shaped.

The convexity of pliable materials 20 and 30 offers a number of advantages. Initially, the preformed convexity of pliable material 20 allows padding device 10 to substantially conform to the curvature of each individual user's hand. Two elements, the preformed convexity and the general flexibility of hand padding device 10, work in combination to achieve this advantage. Substantial initial conformance of hand padding device 10 to the curvature of a hand is important in that more of the surface area of convexly shaped pliable material 20 will be in direct (if hand padding device 10 is placed in the hand) or indirect (if hand padding device 10 is inserted into a pocket or sleeve within a baseball glove) contact with the hand. An increase in the contact area of hand padding device 10 reduces the likelihood that hand padding device 10 will become displaced and not adequately protect the sensitive areas of the hand. Furthermore, reducing gaps between hand padding device 10 and the hand improves the overall force distribution on the hand and reduces the possibility of the enclosure "slapping" against the hand upon impact with a ball.

In contrast to the convexly shaped hand padding device 10 as thus far described, flat foam pads will not perform these functions as effectively. For instance, although foam pads are flexible and will thus generally follow the contour of the hand, gaps tend to exist between the pad and the hand which will cause the pad to "slap" against the hand, causing forces to become concentrated on smaller areas of the hand. Moreover, without a separate restraining device, foam pads will tend to become displaced in the hand and thus increase exposure to injury.

A second advantage of the preformed convexity of hand padding device 10 is that the curvature of pliable material 30 is designed to substantially approximate the curvature of a particular ball, for instance a baseball. For optimal force distribution, the curvature of pliable material 30 should exactly correspond to the curvature of the ball to maximize the area of hand padding device which contacts, directly or indirectly, the ball. However, such a design would detract from the operability of the glove since the ball would have to be caught exactly within the center of the hand padding device 10 to avoid having the ball deflect out of the glove. Therefore, it is preferred that the radius of curvature of pliable material 30 is greater than that of the particular ball.

The above-described interface of curved surfaces (pliable material 30 and a ball) is desirable in a number of respects. Initially, the substantial preformed conformance of pliable material 30 to a ball increases the surface area of hand padding device 10 which a ball will contact, thereby initially applying the impact forces over a larger area. Moreover, the preformed convexity of pliable material 30 reduces the number of creases which tend to develop when hand padding device 10 experiences an applied force. Creases create high stress concentrations in hand padding device 10 which may ultimately lead to rupture. Therefore, it is desirable to reduce the number of creases and thus the high stress concentrations to reduce the probability of hand padding device 10 rupturing in use.

A third advantage of the preformed convexity of both primary surfaces of hand padding device 10 relates to the prevention of "bottoming out." Bottoming out is a condition which occurs when the flowable materials completely migrate from the area of impact to other regions, and thus the pad offers little or no protection in this area. The curvatures of both surfaces of hand padding device 10, namely pliable materials 20 and 30, in combination with the amount of flowable material contained therebetween, substantially reduces the likelihood of hand padding device 10 bottoming out when subjected to an applied force.

Another feature of hand padding device 10 is its general horseshoe shape, best illustrated in FIGS. 1 and 3, which allows hand padding device 10 to define the perimeter of the portion of the hand most in need of protection. Notch 40 generally defines the shape of the portion of the hand from the base of the thumb to the base of the index finger. The remaining boundaries of hand padding device 10 follow the base areas of the fingers, down the side of the hand, and along the base of the hand near the wrist back up to the portion of notch 40 at the base of the thumb. Therefore, hand padding device 10 substantially covers the highly sensitive areas at the base of the fingers, as well as the palm of the hand.

Pliable materials 20 and 30 which form hand padding device 10 define the above-desired horseshoe configuration. Although pliable materials 20 and 30 will be of the same general shape, pliable material 20 must of course be of somewhat larger dimensions since both surfaces of hand padding device 10 are convexly shaped, pliable material 20 forming the inner convex surface. Moreover, the actual dimensions of hand padding device 10 will vary depending upon the general size of the hand to be protected. However, for an average-sized hand, the length of hand padding device 10 will range from about 75 millimeters to about 105 millimeters (illustrated as line A in FIG. 3) and the width from about 70 millimeters to about 100 millimeters (illustrated as line B in FIG. 3). The maximum thickness of the enclosure will typically range from about 5 millimeters to about 15 millimeters in the central region (illustrated as line C in FIG. 3), and the depth of curvature (i.e., the distance from a substantially horizontal plane lying across convex surface 30 to the center of convex surface 20 as best illustrated by line D in FIG. 2) will typically range from about 15 millimeters to about 20 millimeters. In this configuration, the volume of flowable material required to optimize performance of hand padding device 10 will range from about 10 $cm^3$ to about 25 $cm^3$.

In order for padding device 10 to perform properly, the key limitation on pliable materials 20 and 30 is that they are capable of containing the flowable material, that they exhibit a certain degree of flexibility, and that they possess a certain resistance to puncturing. Materials which are suitable for use in padding device 10 include polyurethane or polyvinyl (e.g. polyvinylchloride) materials, acrylonitrile-butadiene-styrene (ABS) resins; acetals; acrylics; cellulosics; chlorinated polyethers; fluorocarbons, such as polytetrafluoroethylene (TFE), polychlorotrifluoroethylene (CTEE), and fluorinated ethylene propylene (FEP); nylons (polyamides); polycarbonates; polyethylenes (including copolymers); polybutylenes; polypropylenes; polystyrenes; polyesters; polysulfones; the preferred material being polyurethane. Depending on the resistance to puncturing of the pliable material used, the thickness of pliable materials 20 and 30 will typically range from about 0.01 millimeters to about 0.08 millimeters.

Another important feature of the hand padding device 10, as well as for all other embodiments, is the use of a flowable material contained within the particular enclosure. The primary advantage of using a flowable material is its ability to react to an applied force and actually migrate to other regions of the padding device to more effectively distribute impact forces over a larger area, the transfer of flowable materials also dissipating a portion of the energy transferred to the enclosure at impact. Therefore, the key limitation on the flowable material used in all embodiments of the present invention is that it possess fluid characteristics. Materials such as wax, glycerin, water, salt water, grease, fats, oils, propylene glycol, and syrup, with viscosities ranging from about 50 centipoise to about 200,000 centipoise, and preferably with viscosities ranging from about 1,000 centipoise to about 100,000 centipoise, can thus be used. The preferred flowable materials are HB Fuller 1454 Hot Melt TM (a flowable microcrystalline wax) and glycerine because they are nontoxic and also will not harm the hand or the glove in the event of a rupture of the enclosure. Small, lightweight particles may also be included in the flowable material to reduce the overall density.

Regarding the method of constructing the preferred embodiment of the present invention, pliable materials 20 and 30 as described above, are affixed to each other, preferably by heat sealing or by using other methods known to those skilled in the art after convexity has been introduced to pliable materials 20 and 30 by vacuum forming. The resulting configuration is thus horseshoe-shaped to form an enclosure having convexly-shaped inner and outer surface. As can best be seen in FIG. 2, for ease of manufacturing, the seal between pliable materials 20 and 30 is a substantially flat surface 25.

A small opening is left in the enclosure for insertion of a filling apparatus (not shown) into the formed enclosure. The filling device is inserted into the opening and a predetermined volume of flowable material is placed therein. When the desired volume has been placed into the enclosure of hand padding device 10, the filling device is removed and the opening in hand padding device 10 is sealed. It is typically unnecessary to remove air from the enclosure prior to sealing since the air will also act as a shock absorbing medium, but of course the additional step of removing air can also be performed so that only flowable material will occupy hand padding device 10.

Regarding the impact absorbtion and distribution characteristics of hand padding device 10, the present invention is used in conjunction with a baseball or other glove which is subjected to concentrated forces generated by catching or contacting a ball. Hand padding device 10 is either placed in the user's hand before the user actually puts on a baseball or other glove or is placed in a sleeve or pocket contained within the glove which is specifically designed to contain such a padding device. When a user catches or contacts a ball in the area of the glove coinciding with hand padding device 10, the ball exerts a force on the glove which is then transferred to certain areas of the convexly shaped pliable material 30. As described above, the area of indirect contact between pliable material 30 and the ball is increased because of the preformed convexity of pliable material 30. Moreover, the convexity of pliable material 20, together with the general flexibility of padding device 10, allows hand padding device 10 to substantially conform to the shape of the user's hand. The cumulative effect of substantial conformance of hand padding device 10 to the ball and the user's hand results in the distribution of the force over a larger area, which in effect reduces the stress introduced onto any one particular region of the hand.

Hand padding device 10 also absorbs a portion of the energy transferred at impact by the energy required to transfer flowable materials away from the point of the force application to other regions of hand padding device 10. Moreover, pliable material 30 will stretch and deform when experiencing an applied force which will also dissipate a portion of the energy transferred at impact.

Figure 4:
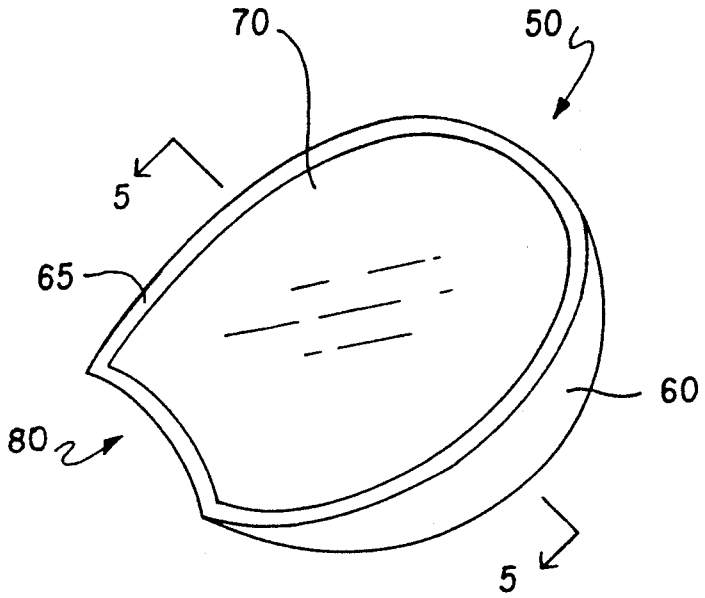
FIG. 4 is a perspective view of another embodiment of the present invention illustrating a first substantially planar surface and the second convex surface.
Figure 5:
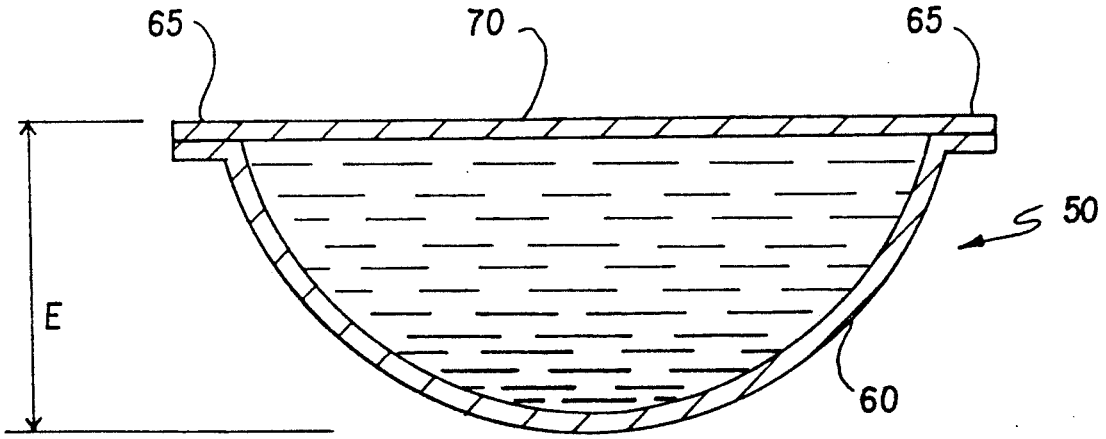
FIG. 5 is a cross-sectional view of the hand padding device of FIG. 4 along centerline 5—5 of FIG. 4.

A second embodiment of the present invention is hand padding device 50 as illustrated in FIGS. 4 and 5. Padding device 50 is similar to hand padding device 10 of FIG. 1 in that it is produced by joining pliable material 60 to pliable material 70 to form a generally horseshoe-shaped enclosure which contains flowable materials, and thus the length and width dimension for hand padding device 10 apply to hand padding device 50. Pliable material 60, like pliable material 20 in padding device 10, has a spherical surface or a surface which is curved in at least one reference plane, being convex in shape. However, unlike padding device 10, the outer surface of padding device 50, namely pliable material 70, is substantially planar in shape, possessing little or no curvature. Due to the planar outer surface of pliable material 70, the depth dimensions of hand padding device 50 will differ from those identified for hand padding device 10. For hand padding device 50, the maximum thickness at the central region of the enclosure, illustrated by line E in FIG. 5, will range from about 15 millimeters to about 20 millimeters. In this configuration, the amount of flowable material required to optimize performance of hand padding device 50 will range from about 10 $cm^3$ to about 35 $cm^3$.

Although the outer surface of hand padding device 50 differs from that of hand padding device 10, the inner surface, pliable material 60, has a convexity similar to that of pliable material 20 in hand padding device 10. Therefore, all of the advantages of this convexity are present in hand padding device 50. Moreover, for ease of manufacturing, a flat seal 65 is formed when pliable material 60 and pliable material 70 are affixed to each other after the convexity has been introduced as was described in the process for forming hand padding device 10.

Particularly regarding the only substantive difference between hand padding device 50 and hand padding device 10, namely the outer surface forming the enclosure which is best illustrated in FIG. 5, hand padding device 50 will suffer from a number of deficiencies not present in hand padding device 10. Specifically, since pliable material 70 is substantially planar, hand padding device 50 will be more likely to develop creases than will hand padding device 10. The creases introduce high stress concentrations which may eventually cause a rupture of hand padding device 50. In addition, the lack of a convex surface which is preformed in substantially the same shape as a ball will result in the forces being initially applied over a smaller area, and therefore will detract from the initial force distribution characteristics present in hand padding device 10. However, hand padding device 50 will still absorb and distribute impact forces more efficiently than known padding devices, as the method of absorbing and distributing impact forces will still be generally as was described for hand padding device 10.

Figure 6:
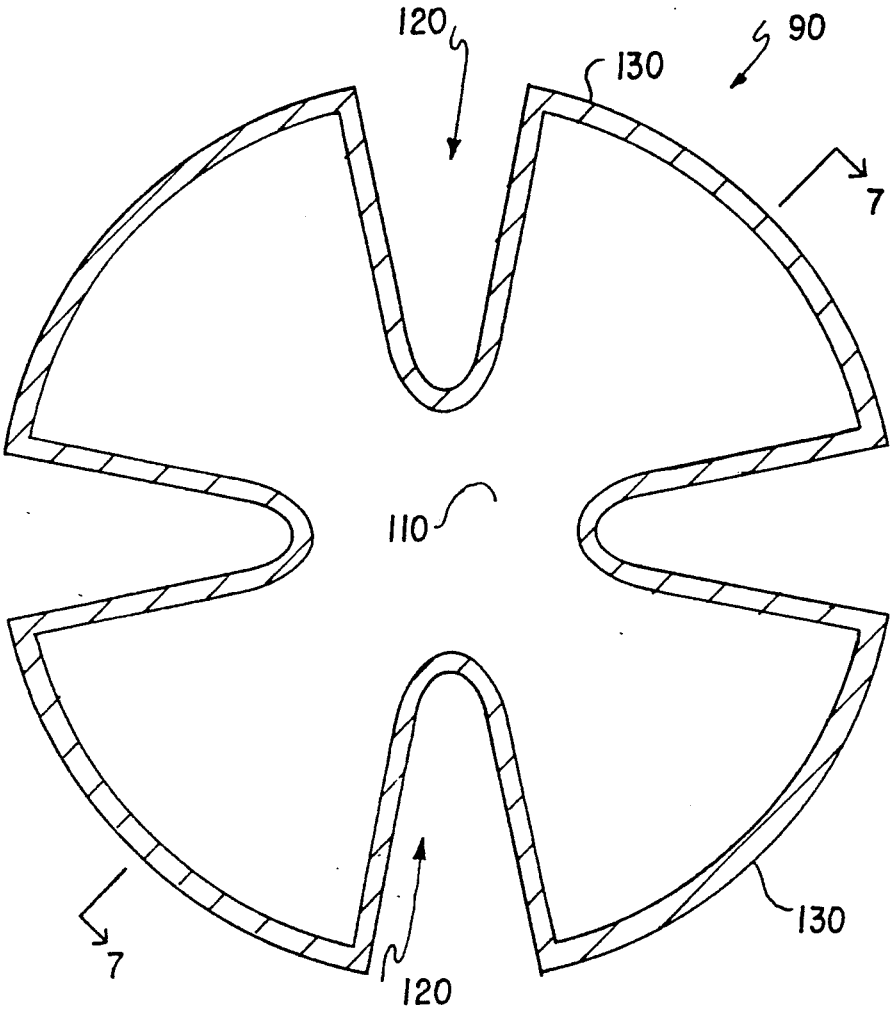
FIG. 6 is a top view of another embodiment of the present invention illustrating a configuration having a central, substantially circular area surrounded by a plurality of extensions.
Figure 7:
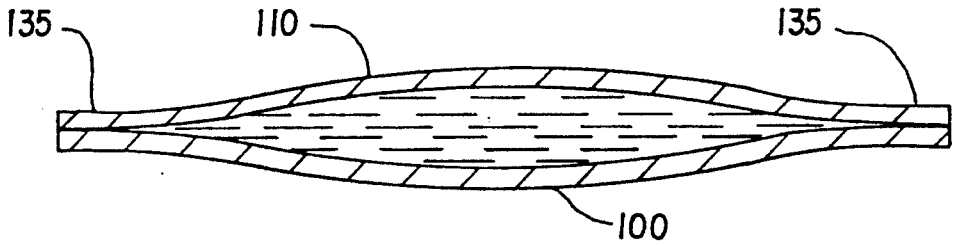
FIG. 7 is a cross-sectional view of the hand padding device of FIG. 6 along line 7—7.

The third embodiment of the present invention is illustrated in FIGS. 6 and 7. Hand padding device 90 is produced by joining pliable material 100 to pliable material 110 to form a generally star or petal-shaped enclosure which contains flowable material. Pliable materials 100 and 110, as can be seen in FIG. 7, are substantially planar, having little or no curvature.

Although hand padding device 90 does not have any preformed curvature, it is still able, based upon pliable materials 100 and 110 exhibiting flexibility characteristics similar to that of pliable materials 20 and 30 in hand padding device to substantially conform to the curvature of the user's hand. Therefore, the previously discussed benefits of substantially following the curvature of the hand apply generally to hand padding device 90. Moreover, when hand padding device 90 substantially conforms to the user's hand, there is a corresponding curvature which will substantially conform to the contour of a ball, resulting in hand padding device 90 possessing the advantages associated with this feature.

Hand padding device 90 is formed from pliable materials 100 and 110 which exhibit the same characteristics as pliable materials 20 and 30 of hand padding device 10. In the configuration of hand padding device 90, the outer contour will be substantially circular with a diameter ranging from about 70 millimeters to about 110 millimeters. The inner region of hand padding device 90 defined by indentations 120 is also substantially circular with a diameter ranging from about 35 millimeters to about 55 millimeters. Hand padding device 90 typically will have a maximum thickness ranging from about 3 millimeters to about 20 millimeters. With this configuration the amount of flowable material required to optimize performance of hand padding device 90 will range from about 10 $cm^3$ to about 20 $cm^3$.

The substantial feature which hand padding device 90 lacks over hand padding device 10 is the preformed curvature, although hand padding device 90 conforms to a curved surface when inserted into a baseball glove. As previously stated, an advantage of the preformed curvatures such as those possessed by hand padding device 10 are a reduction of creases which form when a force is applied to hand padding device 90. However, since hand padding device 90 does not have preformed curvature, it is more likely than hand padding device 10 to develop creases, which may lead to the development of high stress concentrations which could result in the potential rupture of hand padding device 90. However, certain alterations have been made to hand padding device 90 to reduce the development of such creases, namely by incorporating the star- or petal-shaped design as best illustrated in FIG. 6. Essentially, the star or petal-shaped configuration of padding device 90 is produced by introducing a number of slits into a substantially circular material and placing a seam around these slits to define an enclosure. Therefore, a plurality of finger-like extensions 130 and corresponding intentions 120 are produced. The use of these slits helps padding device 90 when it is cupped into the hand.

Regarding construction of hand padding device 90, pliable materials 100 and 110 are cut into the above-described star- or petal-shaped configuration, filled with flowable material and sealed together as was described for hand padding device 10. The shaded regions of FIG. 6 illustrate the region of the seal 135 between the materials which is substantially flat. Hand padding device 90 then absorbs and distributes impact forces in a manner similar to that of hand padding device 10 since convexity, although not preformed, is obtainable due to the pliability of hand padding device 90 and its indentations 120.

Figure 8:
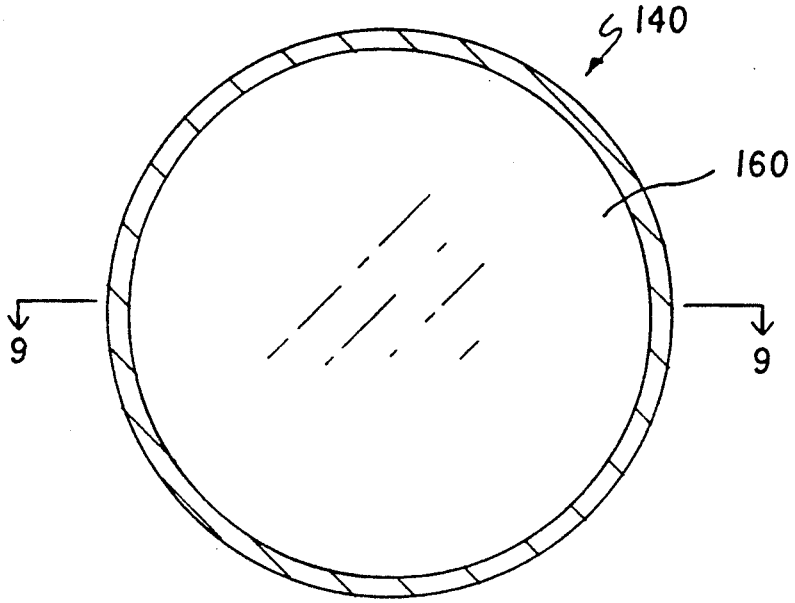
FIG. 8 is a perspective view of another embodiment of the present invention illustrating a substantially planar hand padding device.
Figure 9:
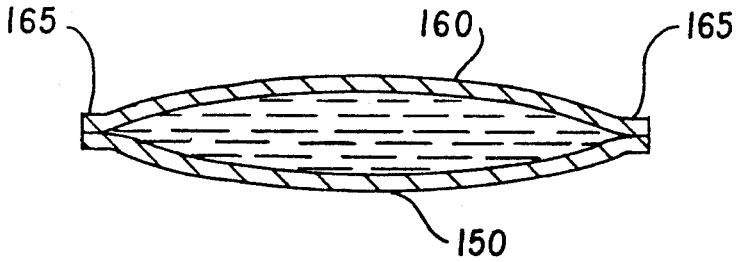
FIG. 9 is a cross-sectional view of the hand padding device of FIG. 8 along line 9—9 of FIG. 8.

A fourth embodiment of the present invention is illustrated in FIGS. 8 and 9. As can be seen in these figures, hand padding device 140 is basically formed by joining pliable material 150 to pliable material 160 to form a generally circular shaped enclosure which contains flowable material. As was the case the hand padding device 90, pliable materials 150 and 160 are substantially planar, exhibiting little or no curvature in an undeformed condition. Furthermore, the outer diameter of hand padding device 140 and its maximum thickness will be similar to those dimensions identified for hand padding device 90. However, the volume of flowable material required to optimize performance of hand padding device 140 will range from about 10 $cm^3$ to about 25 $cm^3$.

Hand padding device 140 will behave similarly to hand padding device 90 in operation or use except that it lacks the means for reducing the stress concentrations produced by the development of creases in hand padding device 140. However, as was the case with hand padding device 90, hand padding device 140 is sufficiently flexible to conform to a curved surface, thereby resulting in padding device 140 possessing the advantages associated with these particular features.

Modifications of the present invention which may be incorporated into any of the embodiments are the horseshoe shape and the extension of the enclosure to substantially cover the index finger. However, for the sake of ease of illustration, these modifications are only shown on the preferred embodiment in FIG. 3. Extension 200 can be added to each of the embodiments to provide protection to a substantial portion of the index finger. Extension 200 will be connected to the respective main embodiment and will thus contain flowable material to offer this protection.

While various embodiment of the present invention have been described in detail, it is apparent that modifications and adaptations of those embodiments will occur to those skilled in the art. However, it is to be expressly understood that such modifications and adaptations are within the spirit and scope of the present invention, as set forth in the claims which follow below.

What is claimed is:

1. A padding device for protecting a palm of a hand of an individual, comprising:

(a) an enclosure formed from at least one pliable material, said enclosure having first and second surfaces and covering a substantial portion of the palm, said first surface facing toward the palm and said second surface facing away from the palm, wherein a substantial portion of said first surface has a preformed first curvature and wherein said first surface has a greater surface area than said second surface; and (b) a flowable material contained within said enclosure, wherein said flowable material exhibits fluid-like characteristics, particularly the ability to flow in response to a force applied to said enclosure.

2. The padding device of claim 1, wherein said second surface is substantially planar.

3. The padding device of claim 2, wherein at least a portion of said enclosure has a length ranging from about 75 millimeters to about 105 millimeters, a width ranging from about 70 millimeters to about 100 millimeters, a maximum thickness in an undeformed state ranging from about 15 millimeters to about 20 millimeters, and wherein said enclosure contains a volume of flowable material ranging from about 10 cubic centimeters to about 35 cubic centimeters.

4. The padding device of claim 1, wherein at least a portion of said second surface has a preformed second curvature, said preformed second curvature curving toward said first surface.

5. The padding device of claim 4, wherein at least a portion of said enclosure has a length ranging from about 75 millimeters to about 105 millimeters, a width ranging from about 70 millimeters to about 100 millimeters, a maximum thickness in an undeformed state ranging from about 5 millimeters to about 15 millimeters, and wherein said enclosure contains a volume of flowable material ranging from 10 cubic centimeters to 25 cubic centimeters.

6. The padding device of claim 1, wherein a perimeter of said second surface of said enclosure approximates an outer contour of a horseshoe.

7. The padding device of claim 1, wherein said flowable material has a viscosity in a range from about 50 centipoise to about 200,000 centipoise.

8. The padding device of claim 1, wherein said flowable material has a viscosity in the range of from about 1,000 centipoise to about 100,000 centipoise.

9. The padding device of claim 1, further comprising an extension of said enclosure which substantially covers the inner surface area of an index finger.

10. The padding device of claim 1, wherein said flowable material comprises a material selected from the group consisting of wax, glycerin, water, salt water, oil, syrup, fats, grease, propylene glycol.

11. The padding device of claim 1, wherein said flowable material comprises a flowable microcrystalline wax or glycerine.

12. The padding device of claim 1, wherein said enclosure comprises a material selected from the group consisting of polyurethane; polyvinyl; acrylonitrile-butadiene-styrene; acetals; acrylics; cellulosics; chlorinated polyethers; fluorocarbons; such as polytetrafluoroethylene, polychloritrifluoroethylene, and fluorinated ethylene propylene; polyamides; polycarbonates; polyethylenes; polybutylenes; polypropylenes; polystyrenes; polyesters and polysulfones.

13. The padding device of claim 1, wherein said enclosure comprises a urethane material.

14. The padding device of claim 1, wherein at least a portion of the palm has a third curvature, said first preformed curvature substantially approximating said third curvature.

15. A hand padding device for protecting a palm of a hand of an individual, comprising:

(a) a flexible enclosure which covers a substantial portion of the palm, said enclosure being a three-dimensional structure and having first and second surfaces, said first surface facing toward the palm and said second surface facing away from the palm, wherein at least a portion of said second surface has a preformed second curvature which curves toward said first surface; and (b) a flowable material contained within said enclosure, wherein said flowable material exhibits fluid-like characteristics, particularly the ability to flow in response to an applied force.

16. The padding device of claim 15, wherein at least a portion of the palm has a third curvature and at least a portion of said first surface has a preformed first curvature, said first preformed curvature substantially approximating said third curvature.

17. The padding device of claim 15, wherein at least a portion of said first surface has a preformed first curvature, said preformed second curvature curving toward said first surface.

18. A hand padding device for protecting a palm of an individual, comprising:

(a) an enclosure formed from a pliable material, said enclosure being substantially planar, having first and second surfaces, having an inner portion with a plurality of substantially equal length extensions connected to said inner portion, and having an indentation separating adjacently located said extensions, wherein said extensions are substantially contained within the palm; and (b) a flowable material contained at least within said inner portion and transferable between said inner portion and said extensions, wherein said flowable material exhibits fluid-like characteristics, particularly the ability to flow in response to an applied force.

19. A hand padding device, comprising:

(a) a pliable, three dimensional, cup-shaped enclosure having two primary surface which are each curved in more than one reference plane, one of said primary surfaces curving toward the other of said primary surfaces, wherein a perimeter of at least a portion of said enclosure substantially approximates the shape of a horseshoe, and wherein at least a portion of said enclosure has a length ranging from about 75 millimeters to about 105 millimeters, a width ranging from about 70 millimeters to about 100 millimeters, and a maximum thickness in an undeformed state ranging from about 5 millimeters to about 15 millimeters; and (b) a flowable material contained within said enclosure and having a viscosity ranging from about 50 centipoise to about 200,000 centipoise, wherein a volume of flowable material contained within said enclosure ranges from about 10 $cm^3$ to about 25 $cm^3$.

20. A hand padding device, comprising:

(a) a glove having a receptacle in the region of a palm of said glove;

(b) a pliable, three dimensional, cup-shaped enclosure having two primary surfaces which are each curved in more than one reference plane, one of said primary surfaces curving toward the other of said primary surfaces, wherein an outer perimeter of at least a portion of said enclosure approximates the shape of a horseshoe; and (c) a flowable material contained within said enclosure and having a viscosity ranging from about 50 centipoise to about 200,000 centipoise, wherein a volume of said flowable material in said enclosure ranges from about 10 $cm^3$ to about 25 $cm^3$.

21. A method of absorbing and distributing an impacting force, comprising:

(a) placing an enclosure containing flowable material into a glove designed to contain said enclosure, said enclosure having first and second surfaces, at least a portion of said first surface having a preformed first curvature and at least a portion of said second surface having a preformed second curvature, said preformed second curvature curving toward said first surface;

(b) applying a force to said glove in the region of said enclosure;

(c) transferring flexible material within said enclosure, wherein said flowable material in said enclosure flows from the area of the applied force to lower pressure regions within said enclosure;

(d) absorbing a portion of the applied force by the energy required to transfer said flowable material within said enclosure; and (e) conforming said padding device to portions of a hand located within said glove, causing said impact forces to be distributed over an area of said hand.

* * * * *